United States Patent [19]

Donahue

[11] Patent Number: 5,035,349

[45] Date of Patent: Jul. 30, 1991

[54] MULTI-COMPONENT STRIPING PASTE DISPENSER

[75] Inventor: Kenneth J. Donahue, West Chester, Pa.

[73] Assignee: Betts Packaging Inc., Florence, Ky.

[21] Appl. No.: 484,519

[22] Filed: Feb. 26, 1990

[51] Int. Cl.[5] ..... B65D 35/08

[52] U.S. Cl. ..... 222/107; 222/94

[58] Field of Search ..... 222/92, 94, 107, 215, 222/145

[56] References Cited

U.S. PATENT DOCUMENTS

| | | | |
|---|---|---|---|
| 2,935,231 | 5/1960 | Paull et al. | 222/94 |
| 4,132,331 | 2/1979 | Mägerle | 222/107 |
| 4,539,259 | 9/1985 | Zuscik | 428/332 |
| 4,842,164 | 6/1989 | Davis | 222/94 |
| 4,927,058 | 5/1990 | Nimmey et al. | 222/106 |

FOREIGN PATENT DOCUMENTS

| | | | |
|---|---|---|---|
| 956377 | 4/1964 | United Kingdom | 222/94 |
| 62-64740 | 3/1987 | Japan | 222/107 |

*Primary Examiner*—Michael S. Huppert
*Assistant Examiner*—Shari M. Wunsch
*Attorney, Agent, or Firm*—Bacon & Thomas

[57] ABSTRACT

A dispenser for dispensing striped paste-like materials, e.g. toothpaste. The dispenser includes a striping assembly including a shoulder member having a central opening, preferably with a threaded neck portion, and a barrier member having a central opening and adapted to be located within the neck portion of the shoulder member. A tubular nozzle with a plurality of radial openings therein is located between the shoulder member and the barrier member to provide a striped effect upon extruding a paste-like material through the assembly. Forcing the paste-like materials from the dispenser can be effected, for example, by squeezing a collapsible tube attached to the striping assembly.

5 Claims, 2 Drawing Sheets

MULTI-COMPONENT STRIPING PASTE DISPENSER

This invention concerns dispensers for dispensing paste-like materials to provide the materials with a striped effect, for example for dispensing striped toothpaste. Although particularly of use in producing visible stripes, dispensers of the invention can be used to dispense paste-like materials with stripes of other substances, for example flavor stripes.

U.S. Pat. No. 2935231 describes a striped toothpaste dispenser consisting of a collapsible tube attached to a two-part striping assembly consisting of a shoulder structure of polyethylene, and a sleeve with openings therein to provide the stripes, the sleeve being received within the threaded neck of the shoulder structure.

Although a striping effect is achieved with such dispensers, if the material forming the stripes contains a flavor additive or a volatile oil, the polyethylene shoulder structure tends to absorb the flavor causing flavor loss from the material to be dispensed. Thus, two piece striping assemblies have found only limited use when the striping materials contain flavor additives and paste-like materials packaged using such assemblies have poor shelf lives.

It is therefore an object of the present invention to provide an improved dispenser for paste-like materials, especially dispensers including a collapsible laminated tube, to overcome or at least reduce the deficiencies of the prior art dispensers mentioned above.

According to the present invention there is provided a dispenser for dispensing a paste-like material to provide the paste-like material with a striped effect, the dispenser including a striping assembly through which the paste-like material is dispensed, the striping assembly comprising:

(a) an outer shoulder member having a central aperture with a neck portion through which the striped paste-like material is dispensed;

(b) a tubular striping nozzle disposed within the neck portion of the shoulder member and having a flanged end portion and a plurality of radial openings intermediate the ends thereof through which in use a paste-like material forming the stripes is dispensed; and (c) a barrier member having a central aperture with a neck portion disposed within the shoulder member, the neck portion of the barrier member retaining the flanged end portion of the tubular striping nozzle thereby to retain the said flanged end portion of the tubular striping nozzle between the shoulder member and the barrier member.

The present invention enables the shelf life of packaged paste-like materials containing flavor oils to be enhanced compared with that of the same materials packaged in hitherto proposed dispensers with two-part striping assemblies.

Dispensers of the present invention include a container for the material to be dispensed, the container preferably being in the form of a collapsible laminate tube.

The striping assembly is preferably assembled by first inserting the tubular nozzle into the barrier member, and then inserting the nozzle and barrier member combination into the shoulder member, the flanged end portion of the nozzle being retained between the barrier member and the shoulder member. The dispenser can then be completed by forming a collapsible tube on the striping assembly by sealing the tube to the outer surface of the shoulder member.

In addition to providing an improvement in the shelf life of materials packaged in dispensers of the present invention, three-part striping assemblies facilitate the production of dispensers having different sizes of outer shoulder member while allowing the same striping nozzle to be used. This has the advantage relating to mold costs, as the striping nozzle can be used with the existing size range of shoulder and barrier components.

Although dispensers of the present invention preferably include a flexible tube which in use is squeezed to dispense the paste-like material through the striping assembly, it should be appreciated that other containers can be used for the material to be dispensed, and other methods can be used by which the paste-like material is dispensed therefrom. For example, the container can be a rigid tube, a piston within the tube being used to effect dispensing of the paste-like material.

An embodiment of dispenser in accordance with the present invention will now be described, by way of example, with reference to the accompanying drawing in which:

FIG. 1 schematically illustrates a longitudinal sectional view of the dispenser partly cut away;

Figure 1:
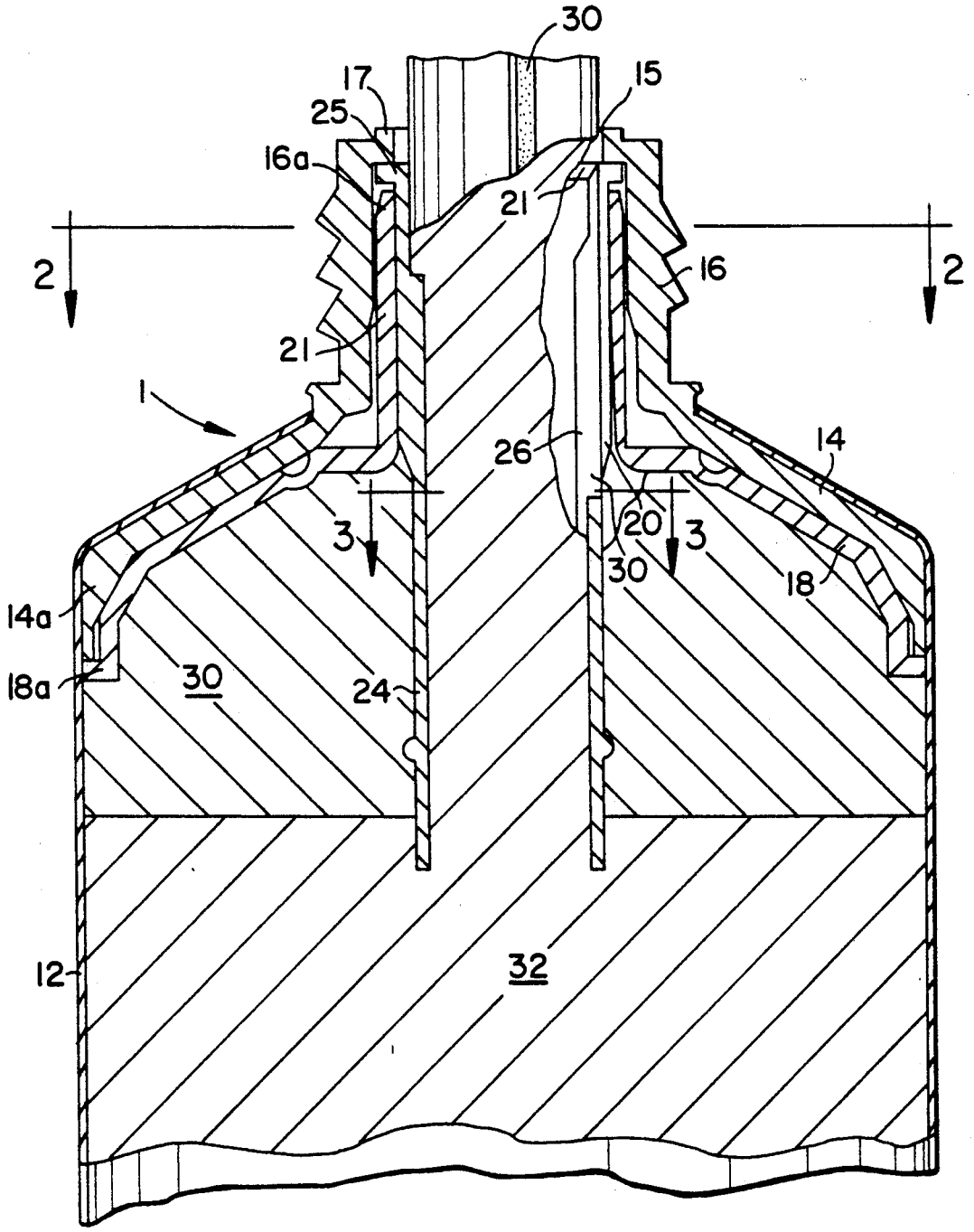
Figure 2:
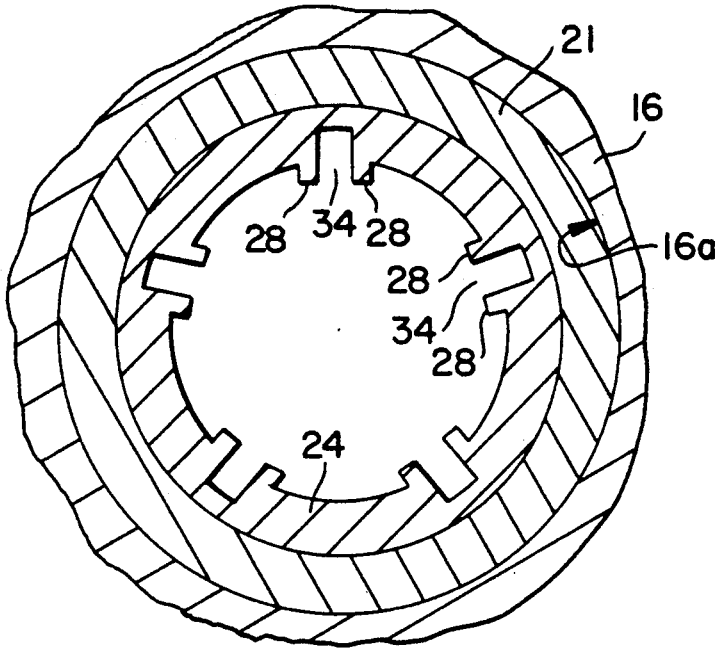
FIG. 2 is a partly cut away section on line 2—2 of FIG. 1.
Figure 3:
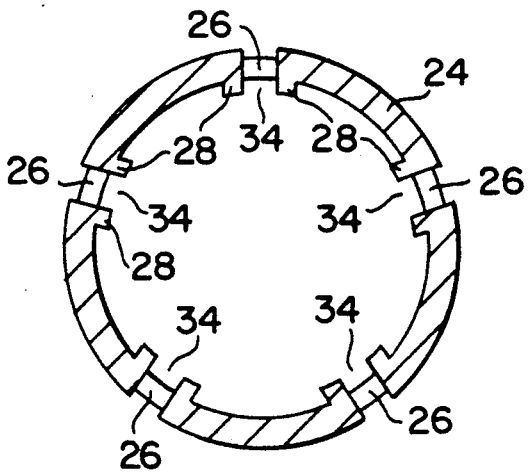
FIG. 3 is a section on line 3—3 of FIG. 1.

The drawings illustrate a dispenser shown generally at 1 consisting of a three-piece striping assembly 10 secured to a collapsible laminate tube 12 for dispensing striped or flavor enhanced toothpaste or other paste-like materials. The assembly 10 consists of an outer shoulder member 14 having a threaded neck portion 16 with a central discharge opening 15 through which the paste-like materials can be dispensed. The threaded neck portion 16 is adapted to receive a cap (not shown) for sealing the contents of the tube 12, as is well known in the art. The threaded neck portion 16 also includes a radially inwardly extending flange 17 for retaining other parts of the assembly 10 within the tube 12, as will hereinafter be described.

The assembly 10 further includes a barrier member 18 having neck portion 21 with a central discharge opening 20 therein, through which paste is discharged. Member 18 abuts the interior surface 16A of the threaded neck portion 16 of the outer shoulder member 14. The assembly 10 also includes a tubular nozzle 24 for effecting striping of the paste-like material, the nozzle 24 having a flanged end portion 25 which abuts flange 17. Nozzle 24 has a plurality of radial discharge openings 26 intermediate its ends. The internal surface of the nozzle 24 has a plurality of integral ribs 28 which extend from the openings 26 towards the flanged end portion 25. Pairs of adjacent ribs 28 provide channels for the passage of a striping or flavor enhancing material from a compartment A of the collapsible tube into the tubular nozzle 24.

The assembly 10 will usually be put together by feeding the tubular nozzle 24 into the barrier member 18, and then inserting the neck portion 21 of the barrier member into the shoulder member 14 so that the flanged end portion 25 abuts the flange 17 of the shoulder member 14. The neck portion 21 of the barrier member is then disposed about the nozzle 24 and the combination is then pushed into the shoulder member 14 so that the neck portion 21 is located between the nozzle 24 and the inner surface 16*a* of the neck portion 16 of the shoulder member 14, as shown in FIG. 1. The tube 12 is sealed in a known manner to the external surface of the outer shoulder member 14, as shown in FIG. 1.

A striping material 30 is then introduced into region A of the tube 12. The remainder of the tube 12 is filled with the paste-like material 32 to be dispensed, and the tube 12 is then sealed. Upon squeezing of the sealed tube 12, the paste-like striping material 30 is forced through openings 26, as shown by the arrow in FIG. 1, into grooves 34 between ribs 28 which direct it towards the opening 15 in the shoulder member 14. The grooves 34 between the ribs 28 are such that upon extrusion of the paste-like material 32 from the tube 12, the material 30 provides a striped effect to the extruded paste-like material 32, as shown in FIG. 1.

If desired, the nozzle 24 can be longer and extend further into the tube 12 to accommodate a larger amount of paste-like striping material 30 compared with the paste-like material 32.

The shoulder member 14 is preferably of polyethylene, e.g. HDPE or LLDPE. The position of the nozzle 24 between the shoulder member 14 and the barrier member 18, prevents the nozzle 24 from being displaced or dislodged during discharge of the paste-like materials from the tube 12. Furthermore, good shelf lives have been achieved with various paste-like materials in collapsible or laminated tubes.

I claim:

1. A dispenser for dispensing a paste-like material to provide the paste-like material with a striped effect, the dispenser including a striping assembly through which the paste-like material is dispensed, the striping assembly comprising:

(a) an outer shoulder member having a central aperture with a neck portion through which the striped paste-like material is dispensed, the neck portion including a flanged end portion outwardly of the interior of the dispenser;

(b) a tubular striping nozzle disposed within the neck portion of the shoulder member and having a flanged end portion for engaging the flanged end portion of the outer shoulder member to retain the striping nozzle within the said neck portion and a plurality of radial openings intermediate the ends thereof through which in use a paste-like material forming the stripes is dispensed; and (c) a barrier member having a central aperture with a neck portion disposed within the shoulder member, the neck portion of the barrier member engaging the flanged end portion of the tubular striping nozzle thereby to retain the said flanged end portion of the tubular striping nozzle between the shoulder member and the barrier member.

2. A dispenser in accordance with claim 1, wherein the barrier member comprises polybutylene terephthalate.

3. A dispenser in accordance with claim 1, wherein the tubular striping nozzle has a plurality of internal ribs extending from each of the plurality of openings to define grooves along which the material forming the stripes is dispensed.

4. A dispenser in accordance with claim 1, wherein the outer shoulder member comprises polyethylene material.

5. A dispenser according to claim 1, wherein the striping assembly is welded to a collapsible tube and the paste-like material is dispensed with a striped effect when the collapsible tube is collapsed.

* * * * *